United States Patent [19]

Galloni

[11] 4,384,623

[45] May 24, 1983

[54] PNEUMATIC FASTENER GUN

[75] Inventor: Giovanni Galloni, Bologna, Italy

[73] Assignee: Panda S.r.l., Bologna, Italy

[21] Appl. No.: 112,566

[22] Filed: Jan. 16, 1980

[30] Foreign Application Priority Data

Oct. 31, 1979 [IT] Italy ..... 3530 A/79
Oct. 31, 1979 [IT] Italy ..... 3531 A/79

[51] Int. Cl.[3] ..... B25C 1/04; B25C 5/13
[52] U.S. Cl. ..... 173/127; 227/130
[58] Field of Search ..... 227/130; 173/127; 91/461, DIG. 3

[56] References Cited

U.S. PATENT DOCUMENTS

| | | | |
|---|---|---|---|
| 2,774,968 | 12/1956 | Osborne et al. | 227/130 |
| 3,056,137 | 10/1962 | Wandel et al. . | |
| 3,099,012 | 7/1963 | Wandel | 227/130 X |
| 3,278,104 | 10/1966 | Becht et al. | 227/130 |
| 3,288,339 | 4/1966 | Bade | 227/130 |
| 4,053,093 | 10/1977 | Thueringer | 227/130 |

FOREIGN PATENT DOCUMENTS

| | | |
|---|---|---|
| 2453595 | 5/1975 | Fed. Rep. of Germany . |
| 1435655 | 3/1966 | France . |
| 2299945 | 9/1976 | France . |

*Primary Examiner*—Werner H. Schroeder
*Assistant Examiner*—Andrew M. Falik
*Attorney, Agent, or Firm*—Fleit, Jacobson & Cohn

[57] ABSTRACT

A pneumatic gun for forcibly inserting fixing elements, such as nails, metal staples and the like. The gun has an operating piston, carrying an arm for firing the fixing elements. The arm slides in a cylinder open at one extremity towards a compressed air tank provided in the stock of the gun. The operating piston is moved by a control piston located above the open extremity which, in turn, is operated by a valve, which is actuated by the trigger of the gun and is movable between two extreme positions. The gun is equipped with an efficient safety device and is so constructed that no torsional stress is applied to the compressed air infeed duct; and so that it can be easily locked onto a suitable support.

27 Claims, 23 Drawing Figures

1
2
2a
7
8
9
10
11
12
13
14
15
16
4
5
52
53
54
6
6b
63
55
61
3a
36
17
26
25
3
19
23
21
24
24a
44
48
47
5
45
46
50
51
56
65
65a
65b
66
67
71
71a
20
70
H
K
72
18a
P4
37
M1
M2
18
33
22
19
49

FIG. 6
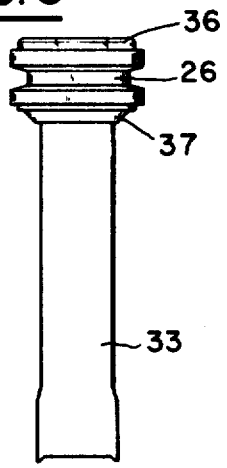
FIG. 7a
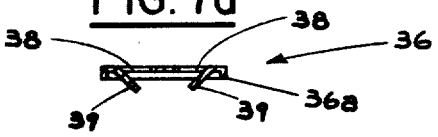
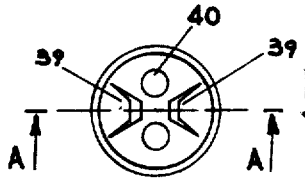
FIG. 7
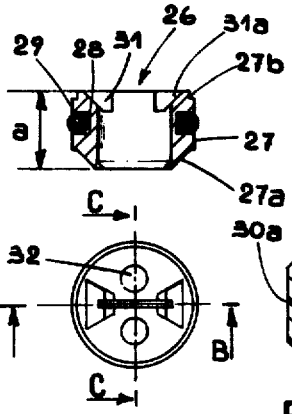
FIG. 9a
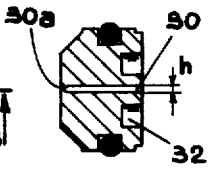
FIG. 9b
FIG. 9
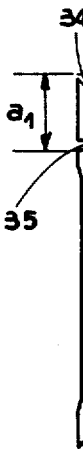
FIG. 8
FIG. 8a
FIG. 10a
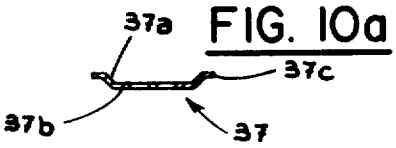
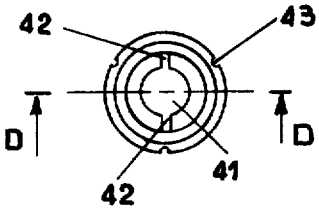
FIG. 10

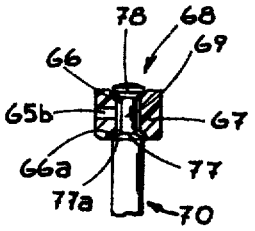
FIG11
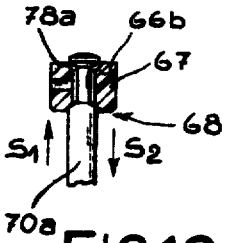
FIG12
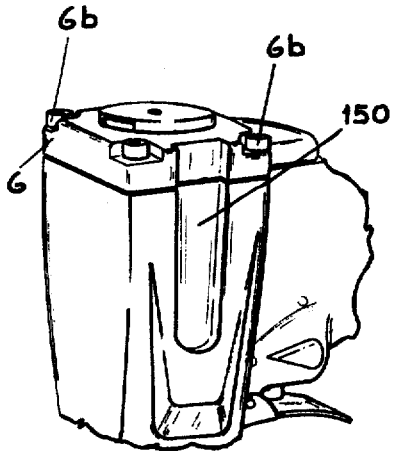
FIG21
FIG22
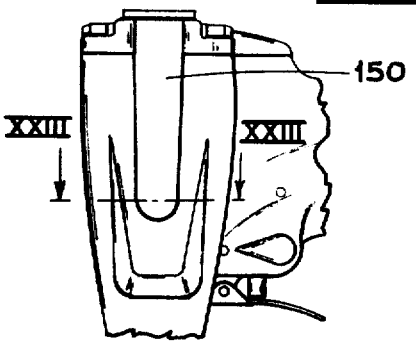
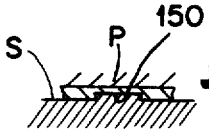
FIG23

PNEUMATIC FASTENER GUN

BACKGROUND OF THE INVENTION

The invention relates to an improved pneumatic gun for forcibly inserting fixing elements, such as nails, metal staples and similar articles.

DESCRIPTION OF THE PRIOR ART

Guns are known for forcibly inserting fixing elements, in particular riveting machines and stapling devices wherein metal staples are used. Such guns have a compressed air actuating system using a large capacity compressed air tank (normally found in the grip of the gun), a cylinder open at the top, in which is slidingly housed an operating piston fitted with an arm for ejecting the fixing elements (the latter being supplied one at a time to a guide or firing channel from a charger or magazine equipped with elastically loaded thrust means), and a control piston movable between a closed position and an open position at the upper open extremity of the cylinder.

The displacement of the control piston towards the open position detemines the almost instantaneous application of strong pressure to the operating piston. An ejector arm of the piston is consequently thrust with considerable force and speed towards an engagement with the apex of the particular fixing element at that moment located in the firing channel. The said fixing element is thus expelled immediately from the firing channel and is forcibly inserted into the material.

In order to render more immediate and efficient the application of the pressure of air to the operating piston, the control piston that opens and closes the communication between the cylinder and the tank is customarily located immediately above the open extremity of the cylinder and is made to move along the axis of the latter in such a way that its displacement towards the open position causes the piston to be immediately exposed to the full pressure of the air contained in the tank.

The said control piston slides in its own guide chamber and is normally maintained in a closed position through the downward thrust exerted onto the upper extremity thereof by the compressed air in the tank, which when non-operative fills the upper extremity of the guide chamber via a linking duct connected to a control valve actuated by the operating trigger of the gun.

The displacement of the said control piston towards the open position is usually brought about by making use of the upward thrust that the compressed air contained in the tank constantly exerts onto an annular peripheral border, protruding laterally with respect to the upper open extremity of the cylinder, with which the lower extremity of the control piston is provided. With the control piston in the closed position the said upward thrust is clearly surpassed by the downward thrust exerted onto the upper extremity of the said piston, and it cannot, therefore, cause the said piston to move towards the open position since the active surface of the said annular border is decisively lesser than the active surface of the upper extremity of the control piston. The term "active surface" is intended to imply the surface exposed to the axial thrust action of the compressed air. When the trigger is pressed and thus the control valve is operated, whereby the communication between the tank and the upper extremity of the aforementioned guide chamber is interrupted and the latter is, instead, placed in communication with a vent, the downward thrust is no longer applied. The compressed air is allowed to act on the annular border of the control piston in such a way as to raise it sufficiently to allow the compressed air to be applied to the full lower surface of the piston. The piston, consequently, moves rapidly towards the open position, while the compressed air passes equally rapidly into the cylinder in order to exert the required thrust action on the operating piston that actuates the ejector arm.

One of the major problems experienced with the use of control pistons of this type is constituted by the reclosing control.

It should, in fact, be noted that the said control piston normally has identical extreme active surfaces and thus the reinsertion of the compressed air in the upper extremity of the guide chamber of the piston produces a condition in which the forces are balanced, clearly not able to return the control piston to the closed position. It is, therefore, necessary to apply to the control piston a supplementary thrust towards the open extremity of the cylinder in such a way as to create the required imbalance with which to prevent the piston from moving towards the said open extremity.

In previously known guns, the said supplementary thrust is provided by a compression spring positioned in between the control piston and the cover that seals the compartment in which the latter is housed. This method, though functionally satisfactory, gives rise to problems resulting from breakages, the setting of the spring and the volume thereof.

The tendency has, therefore, developed to discard the said spring in guns of a more recent type and, instead, to achieve the supplementary reclosing thrust pneumatically. Variations have been made, for this purpose, to the configuration of the control piston with a view to increasing the upper active surface with respect to the lower active surface.

Bearing in mind that control pistons of the type described are generally provided with an axial passage equipped with means capable of alternately opening and closing, in keeping with the position of the control piston, the communication between the open extremity of the cylinder and a vent, a move has essentially been made in two directions, that is to say, to either enlarge the upper outside diameter of the piston with respect to the lower outside diameter, leaving the inside diameters unchanged, or else to reduce the upper inside diameter in comparison with the lower inside diameter, leaving the outside diameters unchanged.

All this calls for sophisticated methods of construction which have a negative effect both on the cost and the weight of the control piston and thus the insertion of compressed air into the cylinder does not constitute an optimum solution. In other words, it is not possible to achieve an instantaneous increase in the pressure exerted on the operating piston, and this represents a considerable disadvantage since the ejector arm cannot be made to move at the maximum possible firing speed at the very moment when the fixing element is about to leave the exit channel of the gun.

The control valves utilized in modern guns have the task of placing the duct that runs into the said guide chamber in communication with the tank (configuration one adopted by the valve), or with the outside atmosphere (configuration two). For this purpose, the movable member of the valve is provided with sealing rings (the well known '0' rings) and thus the movement the said member undergoes is always equal to the sum of the diameter of the said duct and of the gage of the gasket.

The foregoing, in cases when the movable member is secured to a rod whose movement is achieved through one of its extremitites coming into contact with the trigger of the gun, results in the said trigger suffering ample corresponding displacements, and when the gun is being used continuously this can constitute a problem (that this invention limits considerably) for the operator.

In modern pneumatic guns that perform the functions outlined above, the operating piston consists of a body made of impact absorbing, elastic, material, the extremity of which pointing towards the control piston has an enshrouding metal cap. Fastening of the ejector arm to the aforementioned body is achieved through the use of fixing means (for example, dowel pins). This method, which has been adopted by almost all the manufacturers, does not prevent breaking of either the fixing means or that part of the ejector arm affected by the said fixing means.

SUMMARY OF THE INVENTION

The object of the invention is to make available an improved pneumatic gun, the control piston of which makes it possible to realize, for the speed of the working stroke and of the return stroke of the operating piston carrying the ejector arm, values whereby the forcible insertion of the fixing element in a given material and the production potential of the gun itself (the number of fixing elements fired in the unit of time) be rendered optimum (with respect to the similar guns known up until now), with everything being achieved through the use of methods that are simple yet, at the same time, extremely functional.

Another object of the invention is to make available a pneumatic gun of the aforementioned type, the operating piston of which is so shaped as not to cause the breakage of its individual component parts.

A further object of the invention is to make provision for the said gun to have a control valve that performs the functions specified in the introductory part of this description, the construction of which is such that (in comparison with other control valves that carry out the same functions) the travel is limited between its extreme configurations (the cited first and second configuration).

Other, though not less important objects of the invention, consist in the provision of a gun that can be removably locked, in an extremely easy fashion, to a suitable support structure, wherein no torsional stress is applied to the flexible duct that supplies the tank with compressed air. The invention also provides an efficient safety system to prevent the fixing elements from being accidentally fired.

The objects specified above are achieved with the invention, the subject of which is an improved pneumatic gun for forcibly inserting fixing elements, such as nails, metal staples and similar articles. The gun has a compressed air tank, made in the stock of the gun and connected to the compressed air infeed duct; a tubular casing that defines a cylinder, one extremity of which is closed while the other is open towards the said tank; an operating piston, housed slidingly in the said cylinder, carrying a blade type rod or ejector arm, turned towards the closed extremity of the cylinder through which the said ejector arm passes freely, the said ejector arm being intended, during the working stroke of the piston, to intercept and subsequently expel a fixing element into a given article; a control piston, housed slidingly in a guide chamber, positioned at the entrance to the open extremity of the cylinder and movable parallel to the axis of the latter between an open position and a closed position of the said open extremity; a control valve subjected to actuating means that include a trigger and connected to one extremity of a duct, the other extremity of which runs into the terminal part of the said guide chamber relevant to the opposite extremity of the control piston to that turned towards the cylinder, the said valve being movable between two extreme configurations intended to place the said duct in communication with the tank and with the outside atmosphere, respectively; and a pipe that communicates on one side with the outside atmosphere, and on the other with the open extremity of the cylinder, actuated by means that are placed in and out of operation by the control piston at the time it is in the open and closed position, respectively. Essential features of the said improved gun include that the aforementioned control valve consists of a body in which there is a longitudinal through hole that communicates, at one of the intermediate points thereof, with the said extremity of the aforementioned duct, the said hole being communicable at one extremity, with the outside atmosphere and at the other, with the tank. The conformation of the said extremities is such as to define the same number of housings as there are extremities. Complementary heads of a rod, housed freely in the said hole and subjected to the aforementioned control means, mate hermetically with respective ones of said housings. The heads are positioned, one with respect to the other, in a way whereby the mating of one with its housing prevents the other from mating with its housing and vice versa. The mating operations define, for the said valve, the configurations to which prior reference has been made, each of which necessitates a corresponding extreme position on the part of the control piston, the latter having axially in it a through hole that constitutes the part of the said pipe that runs into the open extremity of the said cylinder and that contains, in the center, a diffuser body fixed to the stock of the gun. The control piston is constituted by two parts that are coupled one to the other, the first of which, of a constant diameter section, is housed slidingly and hermetically in the said guide chamber, while the second part is partially inserted into the first part and defines the extremity of the control piston that closes or seals the open extremity of the cylinder, the sealing part of the second part being external to the said first part, annular in shape and of an outside diameter greater than the outside diameter of the cylinder casing. The second part, in the area that defines the corresponding axial hole, has an annular or shaped surface designed to mate hermetically with a complementary surface with which the said diffuser is provided when the said piston is in the open position. The complementary surfaces define, when mating as stated above, the aforementioned means that operate the above mentioned pipe, the occlusion of which causes the operating piston to complete a working stroke. The operating piston is constituted by an impact resistant, elastic, body housed slidingly, in a hermetic fashion, in the aforementioned cylinder and provided, in the center, with a slit in which is hermetically housed the extremity of the said ejector arm that can be locked, by means of two snap-in means, to two covers, each of which wraps tightly around the corresponding end of the above mentioned elastic body.

BRIEF DESCRIPTION OF THE DRAWINGS

In order to render further characteristics and advantages of the improved pneumatic gun according to the invention more obvious, a description is given hereinafter of representative embodiments, with reference to the accompanying drawings, in which:

FIG. 6 illustrates a lateral view of the operating piston complete with ejector arm;

FIG. 7 illustrates a plan view of the upper cover of the piston;

FIG. 7*a* is a view of the section A—A of FIG. 7;

FIG. 8 is a front view;

FIG. 8*a* is a lateral view of the ejector arm;

FIG. 9 is a plan view of the elastic body of the piston;

FIG. 9*a* is a view of the section B—B of FIG. 9;

FIG. 9*b* is a view of the section C—C of FIG. 9;

FIG. 10 is a plan view of the lower cover of the piston;

FIG. 10*a* is a view of the section D—D of FIG. 10;

FIGS. 11 and 12 illustrate the detail H in FIG. 1 with the control valve in the two extreme configurations, respectively;

FIGS. 21, 22 and 23 illustrated, in a perspective view, an external part of the stock, a lateral view, and a view of the section XXIII—XXIII of FIG. 22.

DESCRIPTION OF PREFERRED EMBODIMENTS

Figure 1:
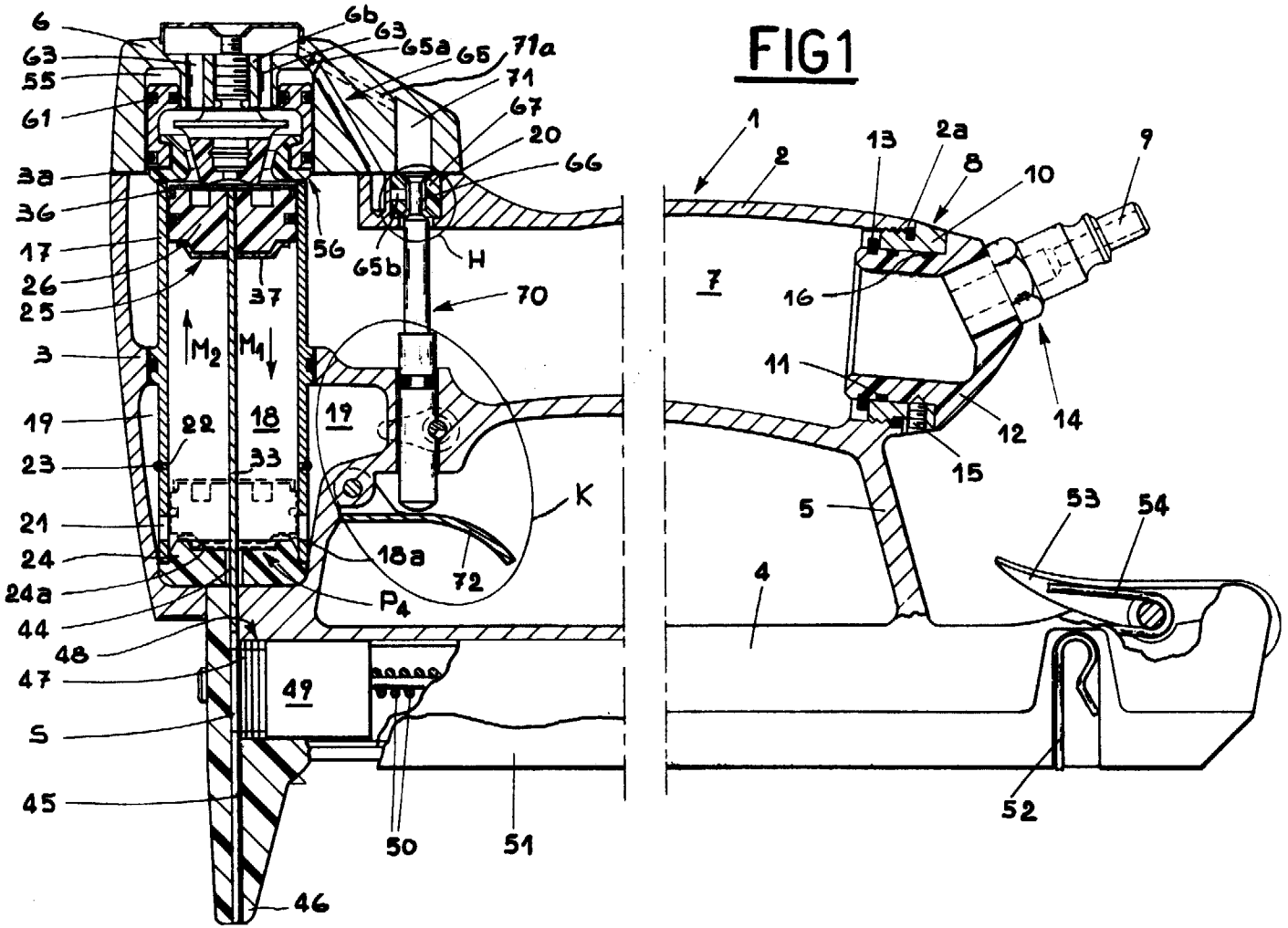
FIG. 1 illustrates a view of the partial lateral section of the gun obtained with the longitudinal plane of symmetry of the said gun; in the said view, certain parts have been removed so that others may become visible.

With reference to FIG. 1, at (1) is shown the stock of the gun; in the said stock can be seen a grip (2), a front body (3) and a longitudinal body (4) perpendicular to the body (3) extending from the part of said grip (2) to which it is connected by means of a rib (5). The front body (3) has at the top a flat smooth surface (3*a*) onto which is placed, with the interposition of a sealing gasket (20), a flat smooth surface of a head (6), the latter being secured to the body (3) by means of the screws (6*b*).

The grip (2) and the upper part of the body (3) house a compressed air tank (7) that is constantly in communication, via the connecting means (8), with a compressed air infeed duct (9); the said means (8) are constituted by a ring (10) screw coupled onto the threaded extremity (2*a*) of the grip (2), which mates freely (in a way rendered hermetic by a gasket (11)) with the extremity of a manifold (12) whose other extremity is fixed (by means of known means shown at (14)) to the duct (9). The connection between the ring (10) and the manifold (12) is achieved using an elastic ring (13) that prevents the manifold (12) from sliding axially with respect to the axis of the ring (10) without, however, impeding the manifold from rotating with respect to its own axis.

The above method whereby the manifold (12) is allowed to rotate with respect to its own axis prevents, in any position adopted by the gun, torsional stress from being applied to the duct (9). A dowel (15) that fits into a threaded housing machined in the ring (10) and whose extremity makes physical contact with a groove (16) made circumferentially, and externally, in the manifold (12) makes it possible to lock the latter in the required position.

The front body (3) is internally hollow so as to be able to accept a tubular casing (17) that defines a cylinder (18). The upper part (with respect to FIG. 1) of the casing (17) is enshrouded by the tank (7), while the lower part is enshrouded by a pocket (19) that communicates with the lower extremity of the cylinder (18) via the apertures (21) and can communicate, again with the said cylinder, via the apertures (22) (of a smaller section than that of the apertures (21)) which, in the extremity turned towards the pocket (19), are sealed by an elastic gasket (23) (of a known type). The said gasket (23) allows, in fact, air to pass from the cylinder (18) into the pocket (19) up to a predetermined pressure gradient but it does not allow the reverse to occur. The distance the apertures (22) are away from the bottom of the cylinder (18) (which is sealed with a disk (24) made of elastic, shock absorption material, more about which will be said in due course) is slightly greater than the height of an operating piston (25) that slides in the said cylinder (see FIGS. 1 and 6).

The piston (25) is constituted by a body (26) made of shock absorbing material (rubber or synthetic resin, for example) which in the external part is of a circular section with a constant diameter in the central part (27), of truncated cone shape (with a decreasing diameter from the inside outwards) in the extremity (27*a*) and with a brusque drop in the diameter in the other extremity that defines a housing (27*b*). The part (27) has in it an annular groove (28) that receives a gasket (29) (of the known 'O' ring type) whose task is to seal the two parts of the cylinder separated by the piston (25).

In the body (26) there is a rectangular section slit (30), symmetrical with respect to two mutually perpendicular axial planes. The said slit (30) is of a constant height h (FIG. 9) over almost its full axial extension, except for the extremity (30*a*) (located on the same side as the extremity (27*a*)) where the said height is practically nil.

In the extremity of the body (27) situated on the opposite side to the extremity (27*a*) there are two cavities (31) (the particular shape of which can be seen in FIG. 9) and these are symmetrical with respect to the longitudinal plane of symmetry of the slit (30). One of the surfaces delimitating each of the cavities (31) (shown at (31a)) has an inclination of 45° with respect to the vertical. Two holes (32) are provided at the side of the said cavities (31).

The slit (30) accepts partially a rod, or ejector arm (33) (FIGS. 6 and 8) of rectangular section. The said ejector arm is provided, in the region of the extremity (33a), with two grooves (34) that originate in the far corners of the ejector arm, oriented at 45° with respect to the longitudinal axis thereof. Laterally the said ejector arm has in it two grooves (35) symmetrical with respect to the said axis, the distance "$a_1$" of which from the extremity (33a) is slightly less than the height "a" of the body (26).

At (36) there is a cover, of circular shape, that constitutes the upper extremity of the piston (25), while at (37) there is another cover, this time of truncated cone shape, that forms the lower extremity of the said piston (25). The said covers (36) and (37) can be removably mated with the ejector arm (33) and, at the same time, they are kept pressed axially onto the body (26).

For this purpose, the cover (36) has in it two slots (38) of "U" shape, symmetrical with respect to a radial plane, and these delimitate two lugs (39) whose gage is identical to the width of the grooves (34), these being bent in one and the same direction (see FIG. 7). The said cover (36) (in which there are two through holes (40)) has its border (36a) bent on the side where the lugs (39) are. The inside diameter of the said border is practically the same as the diameter of the housing (27b) in the body (26), while the outside diameter of the said border is less than the outside diameter of the part (27) of the body (26) (FIG. 6).

The cover (37) has its inner central part (37a) of truncated cone shape complementary to the taper of the extremity (27a) of the body (26). In the center of the said part (37a) runs a hole (41) (of a diameter less than the width of the ejector arm but greater than the width "$a_2$" in the region of the grooves (35)) from which originate two diametrically opposed slits (42). The ejector arm (33) passes freely through said hole (41) and said slits (42). The border (37c) of the cover 37 extends in a circular fashion, its diameter being less than that of the part (26) and, furthermore, it has circumferentially in it three holes (43) arranged at 120° one with respect to the other.

To assemble the piston (25) and lock the ejector arm (37) to it, it is necessary to insert the lugs (39) of the cover (36) into the grooves (34) and, subsequently, by rotating the cover with respect to the longitudinal axis of the ejector arm to snap fasten the latter to the said cover. At this juncture, the cover (36) is enshrouded by the upper extremity of the body (26) and care has to be taken to insert both the lugs (39) in the cavities (31) and to flush fit the border (36a) of the cover (36) into the housing (27b) in the body (26).

Once the foregoing has been done, the ejector arm (33) is inserted into the housing defined by the two slits (42) and by the interposed hole (41), until the said cover has its inner part (37a) flush up against the extremity (27a) of the body (26). At this stage, in order that the slits (42) be placed in the region of the grooves (35), it is necessary to axially compress the body (26) since "a" is greater than "$a_1$". When the said positioning operation has been performed, the cover has to be rotated with respect to the axis of the body (26) in order to effect the snap-in fastening of the cover (37) to the ejector arm (33). The presence of the holes (41) and (43) causes the body (26) to penetrate slightly therein, and this favours both the axial compression of the said body (26) and the locking of it to the cover (37).

The piston (25) is extremely compact and, at the same time, extremely elastic. The two covers (36) and (37) protect the body (26) inasmuch as they prevent it from ripping or being affected by burrs, et cetera, and, at the same time, pass on to it impacts (which it absorbs) consequential to the knocks to which the said piston is subjected at bottom and top dead center. For this purpose, the disk (24) used to seal the extremity (18a) of the cylinder is shaped in such a way as to have a housing (24a) complementary to the external surface (37b) of the cover (37). The arrival of the cover (37) flush up against the disk (24) defines bottom dead center in the stroke of the piston.

The locking of the ejector arm (33) to the piston (25) is achieved without the use of the customary fixing means. Furthermore, on account of the fact that the ejector arm (33) is snap fitted to the covers (36) and (37) and not directly attached to the body (26), the mechanical resistance of the piston (23)-ejector arm (33) assembly is such as not to cause breakages in the latter and this, obviously, is particularly positive. The said ejector arm (33) passes freely through a hole (44) made in the center of the disk (24) and is guided, in its working stroke, by a firing channel (45) machined in the ejection channel (46) of the gun. The firing channel includes a firing station S in which a fixing element (47) (for example, a metal staple) is always present, the said element being the first one in a row (48) of metal staples. The row pusher plate (49), the row pusher spring (50) connected thereto, and the guide slide (51) of the plate (49) along with the slide stop (52) and hook (53) (with the corresponding spring (54)), have been mentioned in a general fashion since all belong to the prior art.

The opposite extremity (18b) of the cylinder (18) to the extremity (18a) is open towards the tank (7). Above the said extremity a guide chamber (55) coaxial with the cylinder (18) is provided in the aforementioned head (6). The diameter of the chamber (55) is greater than the outside diameter of the tubular casing (17) and, furthermore, the extremity of the said chamber that is turned towards the extremity (18b) is spaced slightly away from the latter. This defines an annular aperture (56) that allows the cylinder (18) to communicate with the tank (7). The said aperture (56) is closed or opened by the lower extremity of a control piston (57) movable axially between two extreme positions, that is to say, between the open and the closed position, respectively, of the said open extremity (18b).

The control piston (57) consists of two parts (58) and (59), coupled one to the other, which define an axial through hole (60). The first part (58), of a constant diameter section, is housed slidingly in the guide chamber (55) (the seal being ensured by gaskets (61) of the type known as 'O' rings). The said first part (58), furthermore, is guided slidingly in the inside of the opposite extremity to the open extremity (18b) by a projection (6b) with which the head (6) is provided (again in this case there is a sealing gasket (62)). The second part (59) is inserted partially into the first part (58) and along with the section (59a) that is external to the first part, it defines the extremity of the control piston (57) that seals the said open extremity (18b) of the cylinder (18). The aforementioned section (59a) is annular in shape and its outside diameter, though less than the diameter of the chamber (55), is greater than the outside diameter of the tubular casing (17) of the cylinder (18); the reason for this particular form of construction will be made clear below. The inner surface of the said second part, commencing at the annular border (59*a*) has two consecutive truncated cone sections (59*b*) and (59*c*) that increase in diameter, the inclination of the second one being greater than that of the first. The said hole (60) communicates at its extremity (60*a*) with the holes (63) drilled in the aforementioned projection (6*b*) which, in turn, communicate with the outside atmosphere. The said hole (60) has axially in it a truncated cone shaped diffuser (64) (with a taper complementary to the said section (59*b*)) that is secured to the projection (6*b*). The extremity (64*a*) of the diffuser projects slightly past the plane defined by the surface of the upper extremity (17*a*) of the tubular casing (17) of the cylinder; in this way, top dead center on the part of the said piston (25) is defined by the cover (36) of the piston (25) going flush up against the said extremity.

The extremity of the guide chamber (55) situated on the opposite side to the open extremity (18*b*) of the cylinder (18), communicates with one extremity (65*a*) of a duct (65), the other extremity (65*b*) of which communicates with an intermediate area of a through hole (66) made in the body (67) of a control valve (68). The extremities (66*a*) and (66*b*) are of truncated cone shape, with their diameter increasing from the inside outwards. The said extremities mate hermetically with corresponding conic surfaces (77*a*) and (78*a*) provided on the heads (77) and (78) connected rigidly by a stem (69) that constitutes the final part of a rod (70).

The stem (69) is movable between two extreme configurations, that is to say, the mating configuration of the surfaces (66*b*) and (78*a*) (first configuration), and the mating configuration of the surfaces (66*a*) and (77*a*) (second configuration). In both configurations the hole (66) communicates with the tank (7) and with a duct (71) that communicates with the outside via a duct (71*a*), respectively. With the aforementioned mating configurations a hermetic seal is created, with use being made both of the fact that the mating surfaces have a frustrum extension (not necessarily complementary) and that the surfaces (77*a*) and (78*a*) wedge at one corner into the corresponding surfaces (66*a*) and (66*b*). This fact, together with the absence of sealing gaskets on the stem (69), makes it possible to limit the stroke of the latter, in between its extreme configurations, to fractions of a millimeter. Since the extremity of the rod (70), situated on the opposite side to the stem (69), touches against a trigger (72), the foregoing brings about a limited oscillation of the trigger in order to achieve the above mentioned configurations for the stem, and this is especially advantageous for the operator, particularly when the gun is being used continuously.

The said rod (70) consists of two parts, (70*a*) and (70*b*), respectively, of different sections that create a broken surface (81) subjected to an unopposed axial thrust (originated by the pressure of the air in the tank) in the direction N. The part (70*b*) is seated slidingly in a housing made in the stock (1) of the gun.

In the lower extremity of the part (70*b*), the said rod is subjected to the trigger (72) pivoted at (115) to the stock (1).

Figure 13:
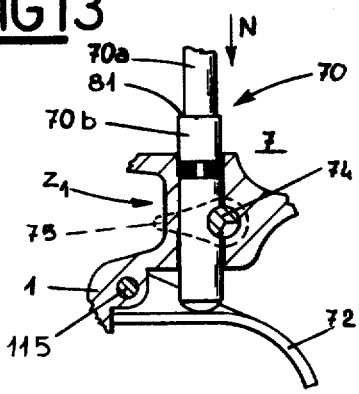
FIGS. 13 and 14 illustrate the detail K in FIG. 1 depicting a first form of embodiment for the safety device of the gun in the locked and unlocked positions of the rod that operates the said valve.
Figure 14:
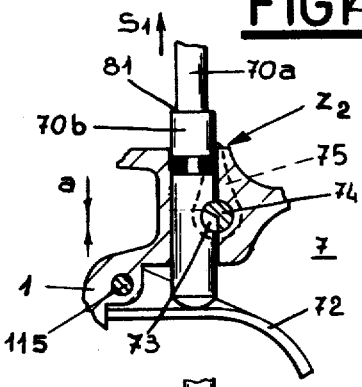

With reference to FIGS. 13 and 14, at (73) there is a housing made laterally in the part (70*b*) and this is delimitated by a spatially curved surface complementary to a spherical sector (74) carried by an arm (75), the latter being pivotally connected to the stock (1) in such a way that it is able to rotate with respect to the axis of the sector (74).

When the arm (75) is in the horizontal position ($Z_1$ in FIG. 13) the sector (74) is partially inserted in the housing (73) and this precludes any movement on the part of the rod (70) (the said rod is thus locked). With the arm (75) in the vertical position ($Z_2$ in FIG. 14), the spherical sector (74) is partially disengaged from the housing (73) and the rod (70) is allowed to effect movements of amplitude "a" sufficient to trip the said control valve (for the unlocking of the rod).

Figure 15:
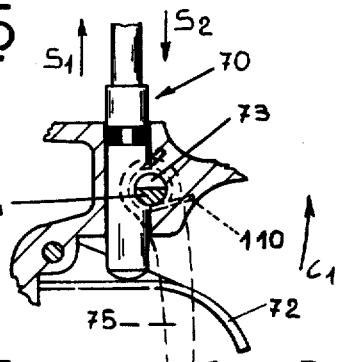
FIGS. 15 and 16 illustrate, in sectional form, a second form of embodiment for the aforementioned safety device, in the locked and unlocked positions of the said rod, respectively.
Figure 16:
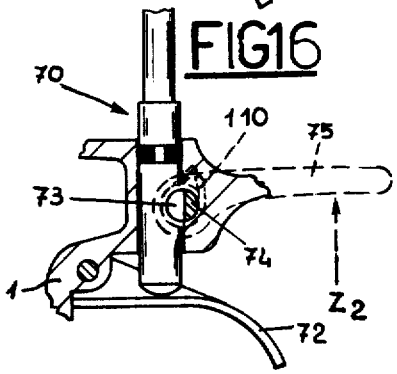
Figure 17:
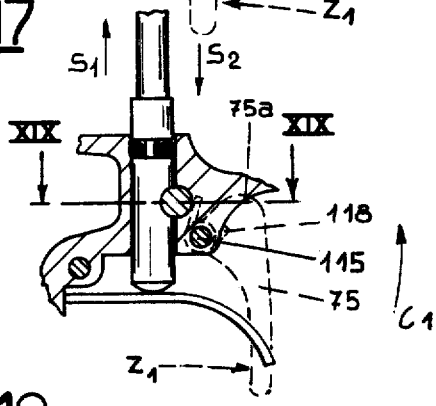
FIGS. 17 and 18 illustrate, in the sectional form, a third form of embodiment for the said safety device, in the locked and unlocked positions of the said rod, respectively.
Figure 18:
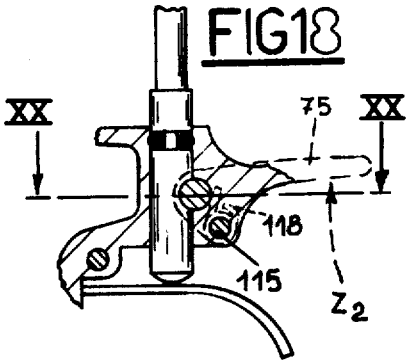

In the second form of embodiment for the safety device (FIGS. 15 and 16) the arm (75), in position $Z_1$, is turned downwards on the same side as the trigger (72) (FIG. 15). In position $Z_2$, the arm is horizontal (FIG. 16).

Prior to touching the trigger (72), the operator moves the arm (75) in such a way as to rotate it in direction $C_1$ from position $Z_1$ to position $Z_2$. In this way, with the rod (70) unlocked it is possible, with the trigger, to cause the said rod to move.

When the movement of the arm (75) on the part of the operator ceases, under the action of a torsion spring (110) mounted on its axis, the arm returns automatically (because of the previously compressed spring being released) to position $Z_1$, that is to say, it automatically locks the rod (70) (automatic action of the safety device).

In the third form of embodiment (FIGS. 17, 18, 19 and 20) a cylinder (111) housed slidingly in a dead hole (113) drilled in the stock (1), the axis of which is perpendicular to the axis of the rod (70), engages with the housing (73). In its central part (111*a*), the cylinder (111) undergoes a brusque decrease in diameter whereby, in cooperation with the hole (113), an annular housing (114) is defined.

Figure 19:
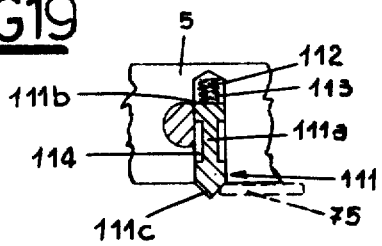
FIGS. 19 and 20 illustrate views of the section XIX—XIX and the section XX—XX in FIGS. 17 and 18, respectively.

The cylinder (111) is subjected to the action of a spring (112), interposed between one of its extremities (111*b*) and the bottom of the hole (113), the function of which is to keep (in the absence of external interference) the other extremity (111*c*) (conical in shape) outside the stock (1) (FIG. 19).

With the cylinder (111) in the position shown in FIG. 19, it is partially inserted into the housing (73) in the rod (70) thereby precluding the latter from undergoing any movement (the rod is blocked).

Figure 20:
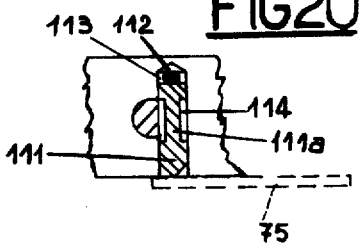

To unlock the rod it is necessary to move the arm (75) (FIGS. 17 and 18) which is articulated at (115) to the stock (1). When, in fact, the said arm is rotated in direction $C_1$ from position $Z_1$ (FIG. 17) to position $Z_2$ (FIG. 18) one of its projecting parts (75*a*) hits against the extremity (111*c*) of the arm (111) (FIG. 20).

This causes the cylinder (111) to return into the hole (113). In this condition (FIG. 20) the housing (114) is centered with respect to the housing (73) and the rod (70) (operated by the trigger (72)) is allowed to make slight movements sufficient, at any rate, to actuate the said control valve. Once the arm (75) ceases to be moved, it returns automatically to position $Z_1$ under the release action of a torsion spring (118) (previously compressed) mounted on its axis. This brings about, under the action of the spring (112), the return of the cylinder (111) to the position shown in FIG. 19, that is to say, the rod (70) is once again locked (automatic operation of the safety device).

To conclude, the said safety device (or "catch") on the gun has a direct effect on the rod (70) and it can be operated by the arm (75) whose extreme positions $Z_1$ and $Z_2$ (pertinent to the locking and the unlocking of the rod) can be recognized without fail by the operator.

In the first form of embodiment, the positions $Z_1$ and $Z_2$ are fixed and the change from one to the other requires action on the part of the operator. In the other two forms of embodiment, position $Z_2$ necessitates the operator constantly moving the arm (75), while position $Z_1$ is automatically adopted once the operator ceases moving the arm (75).

A description will now be given of the above described gun which can normally be used either gripping the grip (2) with ones fingers or, alternatively, making use of the two mutually parallel furrows or guides (150) provided on opposite sides of the outside surface of the front body (3) symmetrically with respect to the plane defined by the ejector arm (33). The furrows, whose conformation is such as to define a dovetail section (FIG. 23), have slightly diverging long sides going towards the head (6) (FIG. 22) and accept corresponding projections provided in a support structure of the right type to which, following the said insertion, the gun stays removably locked. One of the projections P of the support structure S is schematically illustrated in FIG. 23.

Figure 3:
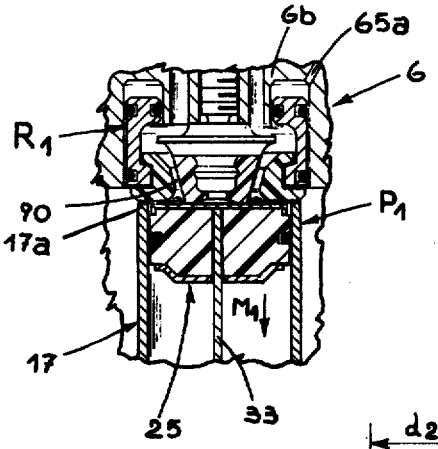
FIGS. 3, 4 and 5 illustrate, in the same scale as in FIG. 1, the control piston in the closed, partially open and fully open position of the open extremity of the cylinder.

When non-operative, the valve (68) is arranged as in FIGS. 1 and 11 (first configuration). The unopposed thrust N exerted by the pressure of air in the tank on the aforementioned surface (81) that is created through a break in continuity between the parts (70*a*) and (70*b*) (of different sections) that constitute the rod (70) (FIGS. 13 and 14) ensures the said non-operative condition being maintained. In this way the duct (65) communicates with the tank (7), and, consequently, the pressure existing in the latter becomes effective in the guide chamber (55). The control piston (57) is subjected to the pressure of the tank over two portions situated on opposite sides, the extension of which is not the same (the area (58*a*) is, in fact, considerably greater than the area, assessed perpendicularly to the axis of the said piston, of the annular aperture (56)) and thus the result of the forces applied to the said piston (57) is such as to keep its annular border (59*a*) pressed against the upper surface of the tubular casing (17): this causes the aperture (56) to be fully closed: the closed position for the control piston (57) (FIGS. 1 and 3).

The pressing of the trigger (72) (with the arm (75) in position $Z_2$) moves the rod (70) in the direction $S_1$ and the valve (68) adopts the configuration shown in FIG. 12 (second configuration). In such configuration, the surfaces (66*b*) and (78*a*) are spaced from each other so that duct (71) communicates with hole (66), extremity (65*b*), duct (65), and extremity (65*a*). In this way the chamber (55), which communicates with extremity (65*a*) is placed in communication with the atmosphere and thus the piston (57) moves in the direction $N_1$ since the thrust exerted on the annular border (59*a*) thereof is not, in any way, opposed.

The movement of the control piston in the direction $N_1$ is ultra rapid on account of the fact that the said piston is extremely light (in comparison with the control pistons in known guns that carry out the same function), and this also depends, in part, on the material used to make it (synthetic resins or light alloys, for example), though to a greater extent it depends on the limited number of parts that go to make up the piston (in this case two) and on their particular conformation.

Figure 4:
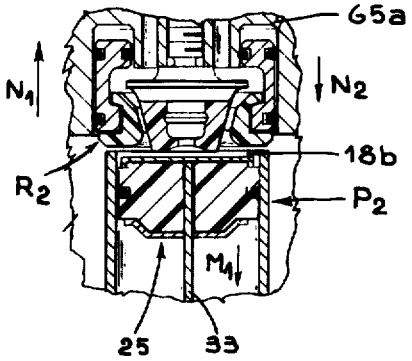
Figure 5:
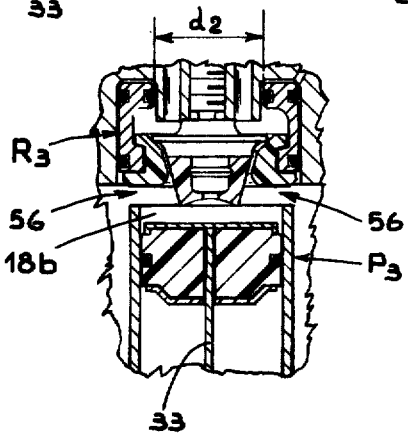

To conclude, the control piston moves from position $R_1$ (FIG. 3) to position $R_3$ (FIG. 5), that is to say, from the closed position to the fully open position of the extremity (18*b*). An intermediate position in the transition from $R_1$ to $R_3$, that is to say, $R_2$ (FIG. 4), has also been illustrated; the aperture (90) between the diffuser (64) and the section (59*b*) circumscribes the quantity of compressed air that leaks outwards. Positions $R_1$, $R_2$ and $R_3$ correspond to the positions $P_1$, $P_2$ and $P_3$ of the operating piston (25). With the control piston in position $R_3$, onto the face of the piston (25) turned towards the extremity (18*b*) of the cylinder is applied the pressure existing in the tank. In the said position, in fact, the frustrum of section (59*c*) of the second part (59) goes flush up against a disk (64*b*) provided in the diffuser (64) and this causes the partial wedging of one edge of the said disk into the aforementioned surface. This suffices to close the hole (60) and, in this way, to preclude any communication between the part (60*b*) of the said hole and the outside atmosphere. The changeover in very short spaces of time of the piston (57) from position $R_1$ to position $R_3$ involves an almost instantaneous application onto the piston (25) of a gradient of pressure practically identical to the relative value of the pressure existing in the tank. In this way, just as soon as the operating piston (25) moves in the direction $M_1$, the maximum pressure compatible with the load losses let in by the aperture (56) is applied thereto. This is particularly important since it allows, immediately after the piston (25) starts to move, the application thereto of the maximum possible force that involves the maximum possible acceleration for the piston (25)-ejector arm (33) assembly, and this is especially advantageous for the metal staple (47) fired, because of the fact that the said staple (47) intercepts, when leaving the exit mouth (46), at the maximum possible speed, the material into which it is to be forcibly inserted.

The movement of the piston (25) in the direction $M_1$ is not hampered by the air present between it and the disk (24) since the said air is purged externally via a hole (44) through which the ejector arm passes freely.

The impact of the piston (25) with the disk (24) results in the cessation of the stroke in the direction $M_1$ (bottom dead center or position $P_4$ shown with dashes in FIG. 1). The energy consequential to the said impact is absorbed by the disk (24) and by the body (26) of the piston (25) which, as stated previously, are made of elastic, shock absorbant material. With the piston (25) in the position $P_4$ there is a unidirectional passage of air, via the apertures (22), from the cylinder (18) to the pocket (19) which, in this way, accumulates compressed air.

Figure 2:
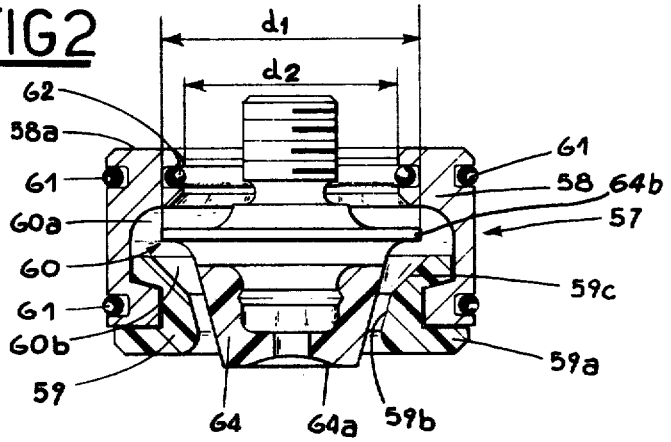
FIG. 2 illustrates, in twice the scale with respect to FIG. 1, a view of the axial section of the control piston and of the associated diffuser.

The release of the trigger (72) causes the rod (70) to move in the direction $S_2$ until the valve (68) reaches the non-operative configuration. When the said situation prevails, the two parts of the piston (57) are subjected to the pressure of the tank but the "active area" (58*a*) is greater than the active area provided on the opposite side thereto since $d_2 > d_1$ (FIG. 2), and it thus ensues that the resulting force applied to the piston causes it to move in the direction $N_2$ until it has been carried into position $R_1$.

With the control piston (57) in the said position $R_1$, the annular aperture (56) is closed (which precludes all communication between the tank and the cylinder) and via the hole (60) (no longer closed), the cylinder (18) is placed in communication with the atmosphere.

The foregoing involves the movement of the operating piston (25) in the direction $M_2$ because of the unbalanced thrust of the compressed air that accumulates in the pocket (19) and, via the apertures (21), flows into the cylinder in the part thereof that is delimitated by the piston (25) and by the sealing disk (24). The movement of the piston (25) in the direction $M_2$ ceases (top dead center) with the impact thereof against the extremity (64*a*) of the diffuser (64). The impact energy related to the said impact is absorbed by the diffuser (64) and by the body (26), both of which are made, as stated earlier on, of elastic, impact absorbing material.

To recapitulate the foregoing, the following are the points that characterize the invention:

(a) the provision of the control valve (68) minus gaskets and springs, and its simple construction and assembly; the body (67) is, in fact, produced with a synthetic resin molding operation, and the head (78) is forced into the hole (66) making use of the elastic deformation of the aforementioned body (67); the absence of gaskets causes, as already pointed out, a very limited stroke on the part of the stem (69) between its extreme configurations (first and second configurations):

(b) the control piston (57) is constructionally simple and easy to assemble (each of the two parts (58) and (59) which go to make it up is, in fact, made in one single body in a synthetic resin or light alloy molding operation, and there is no difficulty in assembling them); furthermore, the two parts that form the control piston are shaped in such a way as to only require a limited amount of material and this results in inertia being limited (with respect to the control pistons of a known type that carry out the same functions) which is optimum since it makes it possible to create, in very short spaces of time, considerable pressure gradients on the operating piston (25) at the time of its working stroke;

(c) the operating piston (25) is compact and absorbs impact, while the covers (36) and (37) that define the extremities thereof can be snap-in locked to the ejector arm (33); all this simplifies the formation of the operating piston-ejector arm assembly considerably and constitutes an improvement both as regards the operation and the life span of the assembly in question;

(d) the safety catch on the gun is simple to make and, at the same time, functional in all three forms; furthermore, in the second and third embodiments, once the arm (75) ceases to be manipulated, the safety catch of the gun automatically returns to the locked position;

(e) the grooves (150) allow the gun to be fixed to a support;

(f) the connecting means (8) prevent the duct (9) supplying the compressed air from undergoing torsional stress;

(g) the conformation of the control piston (57) is such that it is also extremely functional in cases when the corresponding guide chamber (55) is not coaxial with the cylinder (18); the only consequence, in this event, is that the aperture (56) and the cylinder (18) are not coaxial but the former is, however, sealed with the annular border (59*a*); the foregoing affects the construction of the gun favorably since it is possible to make the head (6) independently of the stock of the gun and to subsequently lock (obviously with the chamber (55) already made) the said head to the stock without having to keep to very narrow tolerances for centering it with respect to the cylinder.

It is understood that the preceding description has been given purely as an unlimited example and that modifications of a practical nature may be made to the constructional details without, in any way, deviating from the framework of protection afforded to the invention as described above and in the claims hereunder.

What is claimed is:

1. An improved pneumatic gun for forcibly inserting fixing elements, such as nails, metal staples and similar articles comprising: a gun stock having a compressed air infeed duct; a compressed air tank in the stock of the gun connected to the compressed air infeed duct; a tubular casing that defines a cylinder, one extremity of which is closed while the other is open towards the said tank; an operating piston, housed slidingly in the said cylinder, carrying a blade type rod or ejector arm, turned towards the closed extremity of the cylinder through which the said ejector arm passes freely, the said ejector arm, during a working stroke of the piston, intercepting and subsequently expelling a fixing element into a given article; a guide chamber; a control piston housed slidingly in said guide chamber, said guide chamber being positioned at the entrance to the open extremity of the cylinder so that the control piston is movable parallel to the axis of the guide chamber between an open position opening and a closed position closing said open extremity; a duct; a control valve positioned at one extremity of said duct, said duct having one extremity leading to the control valve and the other extremity running into a terminal part of the said guide chamber relevant to the opposite extremity of the control piston to that turned towards the cylinder, the said control valve being movable between two extreme configurations for placing the said duct in communication with the tank and with the outside atmosphere, respectively; actuating means, including a trigger, for moving said control valve; means for defining a pipe that communicates on one side with the outside atmosphere, and on the other with the open extremity of the cylinder; pipe actuating means for controlling communication through said pipe placed in and out of operation by the control piston at the time it is in the open and closed positions, respectively; said control valve being movable in a body in which there is a longitudinal through hole that communicates, at one of the intermediate points thereof, with the said one extremity of said duct, the said hole being communicable at one extremity, with the outside and at the other, with the tank, the conformation of the said extremities of said hole being such as to define the same number of valve seats as there are extremities, said control valve having complementary heads mating hermetically with respective ones of said valve seats and a rod interconnecting said heads, said control valve being freely movable in the said hole with respect to said body and subjected to said actuating means, the said heads being positioned, one with respect to the other, in a way whereby the mating of one with its valve seat prevents the other from mating with its valve seat and vice versa, the said mating operations defining, for the said control valve, said extreme configurations, each of the control valve extreme configurations having a corresponding extreme position on the part of the control piston, the latter having axially in it a through hole that constitutes the part of the said pipe that runs into the open extremity of the said cylinder and that contains, in the center, a diffuser body fixed to the stock of the gun; the said control piston being constituted by two parts that are coupled one to the other, the first of which, of a constant diameter section, is housed slidingly and hermetically in the said guide chamber, while the second part is partially inserted into the first part and has a portion thereof external of the first part defining one extremity of the control piston that closes the open extremity of the cylinder, the closing portion of the second part forming an end of said control piston and being annular in shape and of an outside diameter greater than the outside diameter of the cylinder casing; the said second part having, in the area that defines the corresponding axial hole, a shaped surface designed to mate hermetically with a complementary surface with which the said diffuser is provided when the said control piston is in the open position, the said complementary surfaces defining said pipe actuation means, the occlusion of said pipe by mating of said complementary surfaces causing the operating piston to complete a working stroke the said operating piston being constituted by an impact resistant, elastic body, housed slidingly, in a hermetic fashion, in the cylinder and provided, in the center, with a slit in which is hermetically housed an extremity of the said ejector arm, and first and second covers, each of which wraps tightly around a corresponding end of the elastic body, having snap-in means for locking the covers on said elastic body.

2. A gun according to claim 1, wherein the said annular shaped portion of the second part of the said control piston, external to the first part, is of an outside diameter no greater than the outside diameter of the said first part.

3. A gun according to claim 1, wherein the said actuating means is constituted by a second rod, partially housed in a sliding fashion in the stock of the gun, one extremity of which is fastened coaxially to the rod interconnecting said heads of the said control valve, while the other extremity comes into contact with an intermediate point of the said trigger, said gun including a safety device engageable with said second rod, constituted by means that operate a member connected to the stock of the gun and movable between two extreme configurations whereby the said member is inserted and at least partially withdrawn, respectively, into and from a housing made in the said second rod, the said member and the said housing being so shaped as to bring about the locking of the said second rod when the former is inserted in the latter, and the unlocking of the said second rod when the former is withdrawn from the latter.

4. A gun according to claim 3, wherein said member is a spherical sector, and said operating means comprises an arm that carries said sector and is rotatably connected to the stock of the gun and revolves along an axis parallel to that of said sector.

5. A gun according to claim 4, wherein said arm is subjected to elastic means for returning it to the position corresponding to the locking of said rod.

6. A gun according to claim 3, wherein said member comprises a cylinder housed in a sliding fashion in a hole provided in the stock of the gun, and subjected to elastic means for stabilizing the at least part insertion of said cylinder into said housing provided in said rod, said cylinder having an intermediate part wherein a brusque decrease in diameter is provided for at least partially disinserting said cylinder from the relevant housing.

7. A gun according to claim 6, wherein said operating means comprises an arm connected rotatably to the stock of the gun and rotating between two extreme positions of non-interference and interference, respectively, with one extremity of said cylinder, correspondingly bringing about the at least partial insertion and disinsertion of said cylinder into and from the housing provided for it in said rod.

8. A gun according to claim 7, wherein said arm is subjected to elastic means for returning it automatically to the position of non-interference with said cylinder.

9. A gun according to claim 1, wherein means for rotatably connecting an extremity of the compressed air infeed duct that runs into the tank, to the stock of the gun are provided in the region of the said extremity.

10. A gun according to claim 9, wherein the said connecting means comprises a ring screw fitted into a hole made in the stock of the gun, and a manifold fixed to the corresponding extremity of the compressed air infeed duct, said ring screw and manifold being rotatably connected to each other.

11. A gun according to claim 10, wherein means for locking the manifold with respect to the ring, in a predetermined position, are provided.

12. A gun according to claim 1, wherein the outer surface of the stock has in it two grooves, or guides, placed symmetrically with respect to the plane defined by the path followed by the said ejector arm, these being provided to accept mated complementarily thereto, projections on a support structure in order that the gun may be removably locked to said support structure.

13. A gun according to claim 12, wherein the longitudinal surfaces of the aforementioned furrows or grooves converge slightly towards the direction of the working stroke of the operating piston.

14. A gun according to claim 12, wherein the cross section of each of the said furrows or grooves is of dovetail shape.

15. A gun according to claim 1, wherein the said diffuser is made of elastic, impact absorbent material and has the extremity turned towards the open extremity of the cylinder projecting with respect to the plane on which the control piston hits against the extremity of the casing relevant to the open extremity of the cylinder.

16. A gun according to claim 1, wherein the said control valve valve has truncated cone extending housings and complementary heads.

17. A gun according to claim 16, wherein the body of the control valve is made in one piece out of material that can undergo considerable deformation, the heads and the relevant nod also being made in one piece.

18. A gun according to claim 1, wherein the surface of the second part of the control piston which mate hermetically with a complementary surface of the diffuser has a truncated cone extension with its diameter decreasing going towards the open extremity of the cylinder, the complementary surface of the diffuser being constituted by the edge of a disk made in the said diffuser.

19. A gun according to claim 1, wherein each of the two parts defining the control piston is made in one single body by means of a molding operation.

20. A gun according to claim 1, wherein the first and the second cover, turned towards the open extremity and the opposite side thereto of the cylinder, keep the elastic body axially pressed, said first cover being provided with two lugs that slope symmetrically with respect to an axial plane and are housed freely in two grooves made in the said elastic body, the said lugs being of a gage and length, evaluated in accordance with the said plane of symmetry, less than the gage and the width, respectively, of corresponding inclined grooves made in the extremity of the ejector arm spaced from the extremity contacting the fixing elements.

21. A according to claim 1, wherein the first and the second cover, turned towards the open extremity and the opposite side thereto of the cylinder, keep the elastic body axially pressed, the ejector arm having in it two grooves, positioned on opposite sides and symmetrical with respect to a transverse plane of the said ejector arm, of a width no less than the gage of the second cover, the latter having centrally in it a through hole of a diameter greater than the width of the ejector arm in the region of the said grooves but less than the width of the remainder of the said ejector arm; the surface defining the said hole having in it two diametrically opposed slits of a width no less than the gage of the ejector arm, which define, in cooperation with the said hole, a housing of a length no less than the width of the said ejector arm.

22. A gun according to claim 1, wherein the inner shaped surface of the second part of the control piston and the complementary surface of the diffuser define, in the said control piston through mating hermetically, an active surface subjected to a lower pressure of the tank than the active surface presented by the extremity of the control piston subjected to the pressure existing in the guide chamber.

23. A pneumatic gun for forcibly inserting fixing elements, such as nails, metal staples and similar articles comprising: a gun stock having a compressed air infeed duct; a compressed air tank housed in the stock of the gun and connected to the compressed air infeed duct; a tubular casing defining a cylinder, one extremity of which is closed while the other is open towards the said tank; an operating piston housed slidingly in the said cylinder, a blade type rod or ejector arm carried by said operating piston and turned towards the closed extremity of the cylinder through which the said ejector arm passes freely, the said ejector arm being intended, during a working stroke of the operating piston, to intercept and subsequently expel a fixing element for it to be forcibly inserted into a given article; a guide chamber positioned at the entrance to the open extremity of the cylinder; a control piston housed slidingly in the guide chamber so that the control piston is movable parallel to the axis of the guide chamber between an open position opening and a closed position closing said open extremity; a duct having first and second extremities, the first extremity communicating with the terminal part of the said guide chamber relevant to the opposite extremity of the control piston to that turned towards the cylinder; a control valve positioned at the second extremity of the duct, the said control valve being movable between first and second extreme configurations intended to place the said duct in communication with the tank and with the outside atmosphere, respectively; actuating means, including a trigger, for moving said control valve from the second to the first extreme configuration; means for defining a pipe that communicates on one side with the outside atmosphere, and on the other with the open extremity of the cylinder; pipe actuating means for controlling communication through said pipe, said control valve being movable in a body in which there is a longitudinal through hole that communicates, at one of the intermediate points thereof, with the said second extremity of said duct, the said hole being communicable at one extremity with the outside and, at the other, with the tank, the conformation of the said extremities of said hole being such as to define the same number of housings as there are extremities, said control valve having complementary heads mating hermetically with said housings and being interconnected with each other by a rod, said control valve being freely movable in said hole with respect to said body and being subjected to said actuating means, said heads being positioned, one with respect to the other, in a way whereby the mating of one with its housing prevents the other from mating with its housing and vice versa, the said mating operations defining, for the said control valve, said extreme configurations, each of the control valve extreme configurations having a corresponding extreme position on the part of the control piston, the latter having axially in it a through axial hole that constitutes the part of the said pipe that runs into the open extremity of the said cylinder and that contains, in the center, a diffuser body fixed to the stock of the gun; the said control piston being constituted by two parts that are coupled one to the other, the first of which, of a constant diameter section, is housed slidingly and hermetically in the said guide chamber, while the second part is partially inserted into the first part and has a portion thereof extending externally of the first part forming a sealing portion for sealing the open extremity of the cylinder, the sealing portion of the second part being annular in shape and of an outside diameter greater than the outside diameter of the cylinder casing; the diffuser body having an extending portion positioned to contact and to limit movement of the operating piston toward the open end of the cylinder; the said second part having, in the area that defines the corresponding axial hole, a shaped surface designed to mate hermetically with a complementary surface with which the said diffuser is provided when the said control piston is in the open position, the said complementary surfaces defining said pipe actuating means, the occlusion of said pipe by mating of said surfaces causing the operating piston to complete a working stroke, said operating piston being constituted by an impact resistant, elastic body, housed slidingly, in a hermetic fashion, in the cylinder and provided, in the center, with a slit in which is hermetically housed an extremity of the said ejector arm, and two covers, each of which wraps tightly around a corresponding end of the elastic body, having snap-in means for locking the covers on said elastic body.

24. In a pneumatic gun for forcibly inserting fixing elements having:

a casing defining a cylinder having one end open and one end closed, the closed end having a through bore formed therein;

an operating piston disposed for sliding movement in said cylinder;

an ejector arm carried by said operating piston and extending through said through bore, said ejector arm ejecting a fixing element when said operating piston moves from said open end towards said closed end;

means for defining a guide chamber positioned at an entrance to the open end of said cylinder;

a control piston disposed for movement in said guide chamber between a first extreme position closing the open end of said cylinder and a second extreme position spaced from the open end;

a compressed gas source communicating with said cylinder when said control piston is in the second extreme position thereof;

means for defining a body having one end communicating with the compressed gas source, one end communicating with the ambient environment, and an intermediate portion communicating with a duct;

means for defining a duct having one end communicating with the intermediate portion of the body and one end communicating with a closed space defined between an end of said guide chamber and an extremity of said control piston facing away from said cylinder;

a control valve disposed for movement in said body between a first extreme position in which communication is established between said closed space and the ambient environment and is blocked between said closed space and said compressed gas source, and a second extreme position in which communication is established between said closed space and said compressed gas source and is blocked between said closed space and the ambient environment;

actuation means for moving said control valve from said second extreme position to said first extreme position; and means for establishing communication between the ambient environment and a space in said cylinder located between the open end of the cylinder and a surface of the operating piston;

the improvement wherein said control piston comprises:

a first hollow part having a constant diameter section housed slidingly and hermetically in said guide chamber; and a second part coupled with said first part and having a portion protruding beyond an extremity of the first part toward the operating piston forming an end of said control piston sealing the open end of the cylinder when said control piston is in the first extreme position thereof, the second part having a shaped portion thereof defining an axial hole communicating with a hole formed in the interior of said first part;

wherein said means for establishing communication includes the holes formed in said first and second parts; a passageway communicating the interior of the first part with the ambient atmosphere; and a diffuser fixed to a stationary part of the gun and having a sealing portion positioned in the interior of said first part, said shaped portion of said second part being movable into contact with the sealing portion of said diffuser when said control piston is in its second extreme position to block communication between said space in said cylinder and the ambient environment, said shaped portion being spaced from said sealing portion when said control piston is in its first extreme position to establish communication between said space in said cylinder and the ambient environment; and wherein said diffuser has a surface thereof positioned to limit movement of said operating piston towards said open end of said cylinder.

25. The improvement of claim 24, wherein said operating piston comprises an impact resistant, elastic body and a cover having a snap fit with the end of the operating piston facing the cylinder open end, the cover engaging and end of said ejector arm and being contacted by said diffuser.

26. In a pneumatic gun for forcibly inserting fixing elements having:

a casing defining a cylinder having one end of the cylinder open and one end closed, the closed end having a through bore formed therein;

an operating piston disposed for sliding movement in said cylinder;

an ejector arm carried by said operating piston and extending through said through bore, said ejector arm ejecting a fixing element when said operating piston moves from said open end towards said closed end;

means for defining a guide chamber positioned at an entrance to the open end of said cylinder;

a control piston disposed for movement in said guide chamber between a first position closing the open end of said cylinder and a second position spaced from the open end;

a compressed gas source communicating with said cylinder when said control piston is in the second position thereof;

means for defining a body having one end communicating with the compressed gas source, one end communicating with the ambient environment, and an intermediate portion communicating with a duct;

means for defining a duct having one end communicating with the intermediate portion of the body and one end communicating with a closed space defined between an end of said guide chamber and an extremity of said control piston facing away from said cylinder;

a control valve disposed for movement in said body between a first extreme position in which communication is established between said closed space and the ambient environment and is blocked between said closed space and said compressed gas source, and a second extreme position in which communication is established between said closed space and said compressed gas source and is blocked between said closed space and the ambient environment;

actuation means for moving said control valve from said second extreme position to said first extreme position; and means for establishing communication between the ambient environment and a space in said cylinder located between the open end of the cylinder and a surface of the operating piston;

the improvement wherein said operating piston is constituted by an impact resistant, elastic body, housed slidingly, in a hermetic fashion, in said cylinder and provided, in the center, with a slit in which is hermetically housed an extremity of said ejector arm; and first and second covers, each of which wraps tightly around a corresponding end of said elastic body, having snap-in means for locking the covers on said elastic body, the first and the second covers keeping the elastic body axially pressed, said first cover being turned towards the open end of said cylinder and being provided with two lugs that slope symmetrically with respect to an axial plane and are housed freely in two grooves made in said elastic body, said lugs being of a gage and length, evaluated in accordance with the plane of symmetry, less than the gage and the width, respectively, of corresponding inclined grooves made in the extremity of the ejector arm that is not destined to intercept the lugs.

27. In a pneumatic gun for forcibly inserting fixing elements having:

a casing defining a cylinder having one end open and one end closed, the closed end having a through bore formed therein;

an operating piston disposed for sliding movement in said cylinder;

an ejector arm carried by said operating piston and extending through said through bore, said ejector arm ejecting a fixing element when said operating piston moves from said open end towards said closed end;

means for defining a guide chamber positioned at an entrance to the open end of said cylinder;

a control piston disposed for movement in said guide chamber between a first position closing the open end of said cylinder and a second position spaced from the open end;

a compressed gas source communicating with said cylinder when said control piston is in the second position thereof;

means for defining a body having one end communicating with the compressed gas source, one end communicating with the ambient environment, and an intermediate portion communicating with a duct;

means for defining a duct having one end communicating with the intermediate portion of the body and one end communicating with a closed space defined between an end of said guide chamber and an extremity of said control piston facing away from said cylinder;

a control valve disposed for movement in said body between a first extreme position in which communication is established between said closed space and the ambient environment and is blocked between said closed space and said compressed gas source, and a second extreme position in which communication is established between said closed space and said compressed gas source and is blocked between said closed space and the ambient environment;

actuation means for moving said control valve from said second extreme position to said first extreme position; and means for establishing communication between the ambient environment and a space in said cylinder located between the open end of the cylinder and a surface of the operating piston;

the improvement wherein said operating piston is constituted by an impact resistant, elastic body, housed slidingly, in a hermetic fashion, in said cylinder and provided, in the center, with a slit in which is hermetically housed an extremity of said ejector arm; and first and second covers, each of which wraps tightly around a corresponding end of said elastic body, having snap-in means for locking the covers on said elastic body, the second cover being turned towards the closed end of the cylinder and cooperating with the first cover to keep the elastic body axially pressed, the ejector arm having in it two grooves, positioned on opposite sides and symmetrical with respect to a transverse plane of the said ejector arm, of a width no less than the gage of the second cover, the latter having centrally in it a through hole of a diameter greater than the width of the ejector arm in the region of the said grooves but less than the width of the remainder of the said ejector arm; the surface defining the said hole having in it two diametrically opposed slits of a width no less than the gage of the ejector arm, which define, in cooperation with the said hole, a housing of a length no less than the width of the said ejector arm.

* * * * *